US005120138A

United States Patent [19]

Midgley et al.

[11] Patent Number: 5,120,138

[45] Date of Patent: * Jun. 9, 1992

[54] FLEXIBLE BAG CLOSURE SYSTEM

[75] Inventors: Roland R. Midgley, Minneapolis; Keith E. Moe, Woodbury; Bradley W. Eaton; William J. Bond, both of St. Paul, all of Minn.

[73] Assignee: Minnesota Mining and Manufacturing Company, St. Paul, Minn.

[ * ] Notice: The portion of the term of this patent subsequent to Aug. 20, 2008 has been disclaimed.

[21] Appl. No.: 656,293

[22] Filed: Feb. 15, 1991

Related U.S. Application Data

[63] Continuation-in-part of Ser. No. 560,430, Jul. 30, 1990, Pat. No. 5,000,902.

[51] Int. Cl.[5] ..... B65D 33/38; B65D 33/30

[52] U.S. Cl. ..... 383/7; 383/43; 383/71; 383/120; 220/404

[58] Field of Search ..... 383/33, 43, 71, 120, 383/2, 7; 220/404

[56] References Cited

U.S. PATENT DOCUMENTS

| | | | |
|---|---|---|---|
| Re. 28,688 | 1/1976 | Cook | 260/4 |
| 2,631,629 | 3/1953 | Lee | 383/43 X |
| 3,733,024 | 4/1973 | Bolling, Jr. et al. | 383/2 X |
| 3,819,401 | 6/1974 | Massengale et al. | 156/85 |
| 3,912,565 | 10/1975 | Koch et al. | 156/85 |
| 3,974,960 | 8/1976 | Mitchell | 229/62 |
| 4,136,071 | 1/1979 | Korpman | 260/27 BB |
| 4,314,558 | 2/1982 | Korpman | 383/43 X |
| 4,477,950 | 10/1984 | Cisek et al. | 24/30.5 P |
| 4,509,570 | 4/1985 | Eby et al. | 383/33 X |
| 4,738,478 | 4/1988 | Bean, Jr. | 294/55 |
| 4,747,701 | 5/1988 | Perkins | 383/33 |
| 4,762,430 | 8/1988 | Bullard | 383/75 |
| 4,813,792 | 3/1989 | Belmont et al. | 383/75 |
| 4,813,793 | 3/1989 | Belmont et al. | 383/75 |
| 4,813,794 | 3/1989 | Herrington | 383/75 |
| 4,861,635 | 8/1989 | Herrington | 428/40 |
| 4,906,108 | 3/1990 | Herrington et al. | 383/71 |
| 4,908,247 | 3/1990 | Baird et al. | 383/71 X |
| 4,913,560 | 4/1990 | Herrington | 383/71 |
| 4,953,704 | 9/1990 | Cortese | 383/43 X |
| 4,989,994 | 2/1991 | Gelbard | 383/33 X |
| 5,000,325 | 3/1991 | D'Elia | 383/33 X |
| 5,040,902 | 8/1991 | Eaton et al. | 383/71 X |

FOREIGN PATENT DOCUMENTS

| | | |
|---|---|---|
| 547177 | 8/1942 | United Kingdom . |
| 2160473A | 12/1986 | United Kingdom . |

*Primary Examiner*—Stephen Marcus
*Assistant Examiner*—Jes F. Pascua
*Attorney, Agent, or Firm*—Gary L. Griswold; Roger R. Tamte; William J. Bond

[57] ABSTRACT

A bag and liner, wherein the bag is maintained open by an attached elastic band. Preferably, the elastic is placed on either side of at least one gusset fold(s) in an untensioned state, so as to bridge the gusset. When the bag top is folded over a container rim, the elastic is stretched on the outside of the container. This placement permits the bag to be folded flat while providing a means to keep the bag open during use. The elastic is useful as a closure after use.

32 Claims, 3 Drawing Sheets

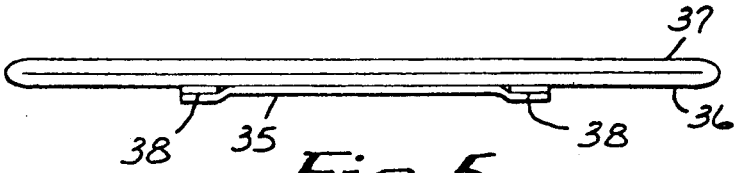
Fig. 5
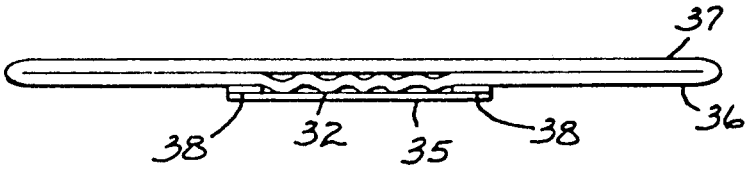
Fig. 6
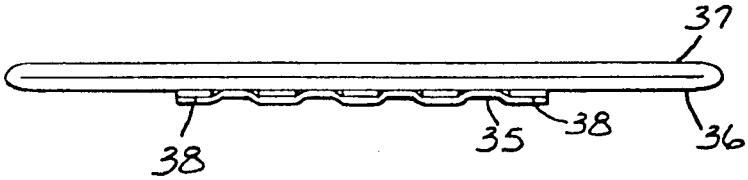
Fig. 7
Fig. 8
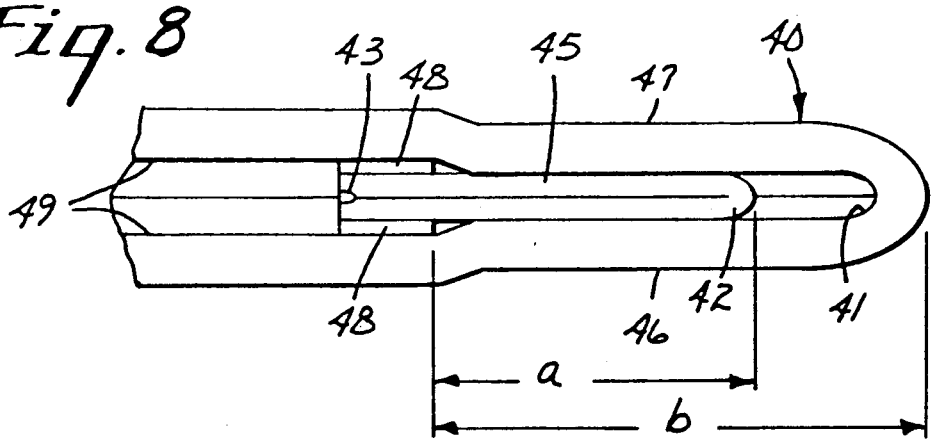
Fig. 15
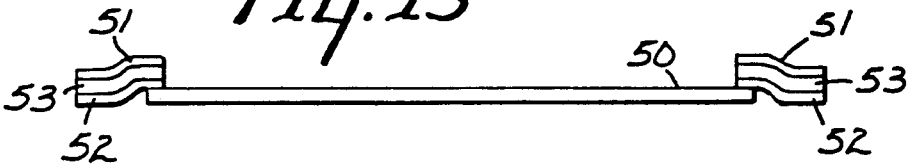

FLEXIBLE BAG CLOSURE SYSTEM

CROSS REFERENCE TO RELATED APPLICATION

This application is a continuation-in-part of U.S. Ser. No. 07/560,430 filed Jul. 30, 1990 now U.S. Pat. No. 5,040,902.

FIELD OF THE INVENTION

The present invention relates to bags and, more particularly, trash bags with supplemental means to keep the bag open in use and closures therefore.

BACKGROUND OF THE INVENTION

Plastic trash bags are produced and sold on an extensive scale in a variety of shapes and sizes. The vast majority of these bags are made of polyethylene film. The bags are generally quite simple, having an open end with straight sidewalls, often joined by a seam(s), with a closed bottom. The trash bags also serve as trash can liners. Conventionally, the upper edge of the bag is rolled over the upper lip of the trash container. A problem, however, is how to keep the bag open and attached to the top of the container. Some trash cans are described as having means to secure the trash bag to the container, such as U.S. Pat. No. 4,738,478 (Bean), who describes a rigid retaining ring with an elastic band that fits within a U-shaped track in the rigid ring. The bag is retained on the trash can by the elastic band. Of course, this is only a limited solution. It has also been proposed to place an elastic band on the trash bag itself in U.S. Pat. No. 4,509,570. The elastic band is located in a hem at the top of the trash bag along its full circumference in a stretched condition. However, this construction has disadvantages in terms of cost, manufacturing and packaging. A major problem with the construction is that the bag top will gather when the elastic is released, whereas most bags are required to fold into a flat sheet for efficient manufacturing and packaging, virtually impossible with a bag gathered around its full circumference. U.S. Pat. No. 4,747,701 (Perkins) proposes a solution to the gathering problem. Perkins places a wide elastic band at the rim of the bag which has the same circumference as the main plastic side portions of the bag. The wide elastic band (2 to 5 inches wide) is then turned over onto the rim of an appropriately sized trash container. This allegedly causes a slight elongation of the elastic band which will retain the bag on the rim. This is an expensive solution, as significant amounts of elastic are used. Additionally, unless the trash container rim circumference is closely matched to that of the trash bag, this method is likely ineffective. Too large a trash container will create excessive shear stresses in the elastic increasing the likelihood of detachment from the main bag. A trash container rim with a circumference about the same as or smaller than the trash bag circumference will not create enough elastic retraction force to retain the bag.

Another area of concern is how to close the bag following use. Conventional closures include twist ties (metal wires) or plastic closures such as discussed in U.S. Pat. No. 4,477,950 (Cisek, et al.). It has also been proposed to attach closure elements to the bags themselves, e.g., U.S. Pat. No. 3,974,960 (Mitchell) (a plastic tie strip), and U.S. Pat. Nos. 5,913,560, 4,906,108 and 4,813,794 (all to Harrington or Harrington, et al.), that describe tacky plastic closures. The use of draw strings or tape is also popular as discussed in U.S. Pat. Nos. 4,762,430 (Ballard), 4,813,792 (Belmont, et al.) and 4,813,793 (Belmont, et al.). However, these closures do not address the problems of how to keep the bag open and attached to the trash container.

The present invention is directed at solving some of the problems with the prior art by providing a simple means that will serve to keep a bag open in use while also serving as a closure, which is advantageous in terms of cost, packaging and manufacture.

BRIEF SUMMARY OF THE INVENTION

The invention is directed to a bag and liner, wherein the bag is maintained open by an attached elastic band. The elastic is preferably placed on either side of at least one gusset fold(s) in an untensioned state, so as to bridge the gusset. The elastic is at a position near the top of the bag such that when the leading edge is folded over the container rim, the elastic is on the outside of the container. This elastic can be placed over more than one gusset. This placement permits the bag to be folded flat while providing a means to keep the bag open during use and useful as a closure after use. In a further aspect of the invention, the material employed is a non-tacky laminate material which when placed over the container is stretched and becomes elastic.

BRIEF DESCRIPTION OF THE DRAWINGS

FIG. 5 is a top view of an alternative embodiment of the invention.

FIG. 6 is a top view of the alternative embodiment of the invention depicted in FIG. 5 with the elastic in its relaxed condition.

FIG. 7 is an alternative method of attaching the alternative embodiment of the invention of FIG. 5.

FIG. 8 is another alternative embodiment of the invention.

FIG. 15 illustrates an elastic construction where the elastic is attached by separate tape elements.

DESCRIPTION OF THE PREFERRED EMBODIMENTS

Figure 1:
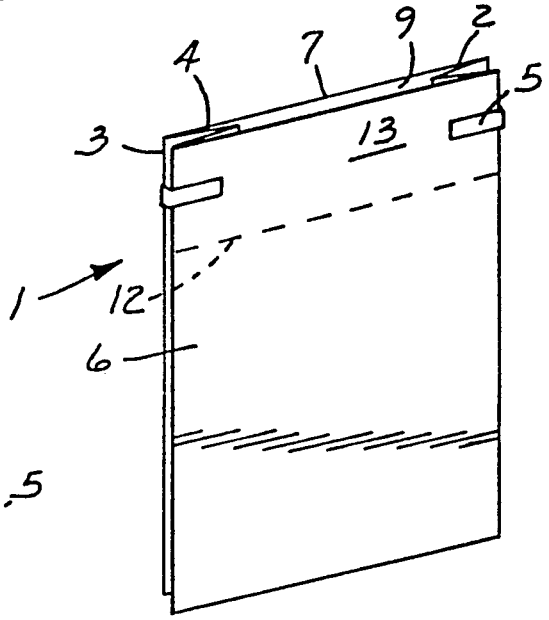
FIG. 1 is a bag having attached elastic according to the invention.

FIG. 1 illustrates an embodiment of the invention using a gusseted bag 1. The gusseted bag 1 has two opposing gussets or folds 2. This bag 1 will include a front 6 and rear 7 panel. The sides of the bag 1 have been longitudinally folded into gussets 2, which as shown are on opposing side edges of the bag 1. Each of the gussets 2 have leading edge folds 3 defining the longitudinal edges of the front 6 and rear 7 panels with the gussets separating the panels. Interposed between the leading edge folds is at least one inner fold region 4. The bag material forming the inner fold region 4 is interposed between front and rear panels 6 and 7. The bottom of the bag 1 is sealed, generally by heat sealing.

Figure 3:
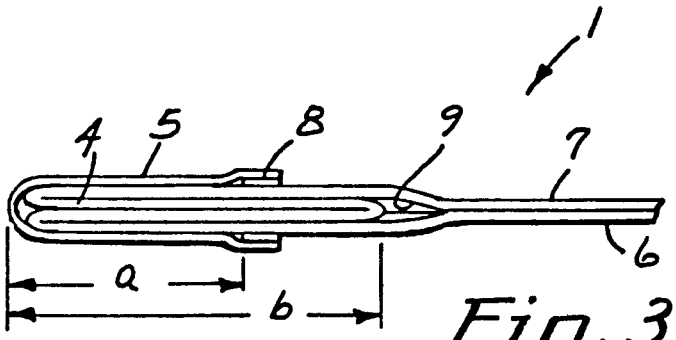
FIG. 3 is a top view of the elastic as attached to the gusseted bag of FIG. 1.
Figure 9:
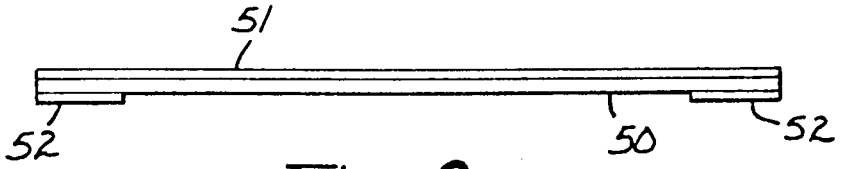
FIG. 9 is an elastic tape construction usable in the embodiments of the invention.
Figure 10:
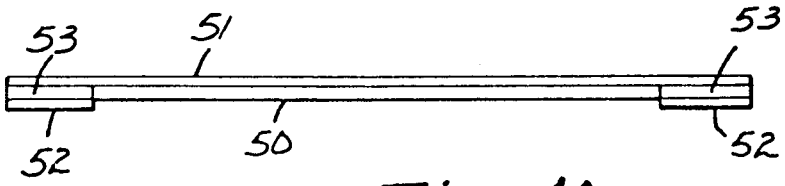
FIG. 10 is an alternative elastic tape construction usable in the embodiments of the invention.
Figure 11:
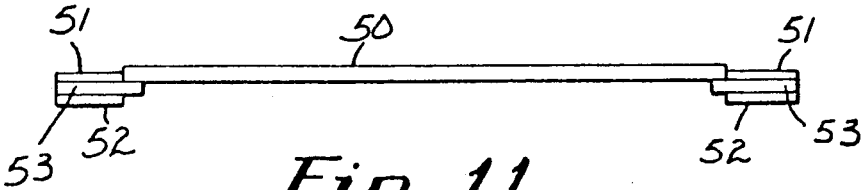
FIG. 11 is an alternative elastic tape construction usable in the embodiments of the invention.

As seen generally in FIGS. 1 and 3, transversing at least one gusset, is an elastic member 5. The elastic member is attached at its ends 8 to both the front and rear panels 6 and 7. The elastic fold is preferably closely adjacent the edge folds 3. When so placed, the elastic will lie flat allowing ready packaging of the bag. The elastic member is located at or near the top open end of the gusseted bag 1. The elastic can be placed up to the top edge of the bag which, for bags with an uneven top profile, is the highest edge with bag film continuously along the full circumference of the bag. Preferably, however, the elastic would be placed ⅛ to 6 inches (0.3 to 15.1 cm) from the top edge of most bags, such as trash bags.

Figure 2:
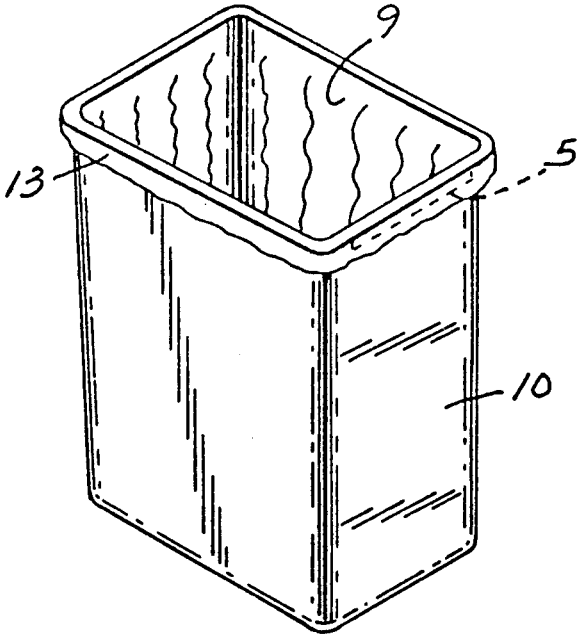
FIG. 2 is a bag in accordance with FIG. 1 as it would be used on a container.

In use, as shown in FIGS. 1 and 2, the upper edge portion 13 of the bag will be turned over the top of the container at approximately line 12. Included on this turned over portion 13 is the elastic member. When the bag is so placed on the appropriate size container 10, the gusseted side edges will open up exposing the bag interior 9. This will stretch the elastic attached to the front and rear panels 6 and 7. In the embodiment illustrated in FIG. 1, with the elastic fold directly adjacent the edge folds 3, the maximum amount of stretch will equal twice the fold length (2 times b in FIG. 3). The strain imposed by the stretched elastic will retain the edge portion 13 on the lip of the container 10. After the bag is full, it is removed from the container. The edge portion 13 of the bag can then be gathered by the user. The gathered or twisted top portion of the bag can be maintained by an independent closure element such as a twist tie or plastic closure as per U.S. Pat. No. 4,477,950. However, advantageously, the elastic member 5 can be wrapped around the gathered portion to effect closure of the bag without the need for a separate closure element.

Elastic members can be placed on one or both gusset folds. Placing elastic on two gusset folds will more evenly distribute forces and allow greater flexibility in the fitting of various container sizes. Shorter elastic can also be used, which is more suited for use as a closure after the bag is full. Alternatively, a bag could be made having side gussets.

Figure 4:
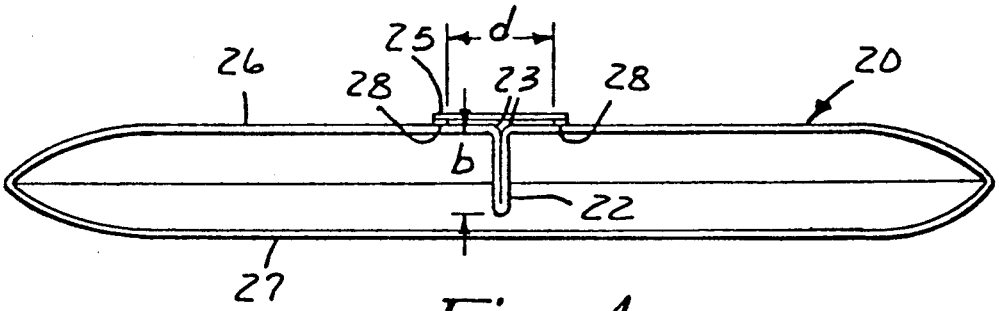
FIG. 4 is a top view of an alternative embodiment of the invention.

An alternative embodiment is shown in FIG. 4 where the gusset 22 is located on a panel 26 and/or 27 of the bag 20. The elastic member 25 is attached at either side of the edge folds 23 of the gusset 22. The area of elastic available for stretching d between the attachment regions 28 can bridge the gusset in either a centered or off-centered manner. However, a centered location is preferred. The amount of material in the fold determines the maximum amount of stretch. In FIG. 4, this is two times b. Although one gusset is depicted in FIG. 4, two or more gussets can be present at any location on either panel.

A non-gusseted alternative is shown in FIG. 8. In this figure, the elastic member 45 is located within the elastic bag 40. In this embodiment, the elastic, instead of bridging a gusset in the bag 40, is included within a larger edge fold 41 of the bag 40. The elastic member 45 is attached to opposing inner faces 49 of the bag on opposite sides, 47 and 46, of the bag adjacent the fold 41. The amount of bag material (2*b) between the two attachment points 48 determines the maximum length of the elastic material (2*a) between the two attachment points 48. The elastic member 45 shown in FIG. 8 has one fold 42 between the attachment points 48. If desired, the elastic member 45 could be folded in the opposite direction to that shown in FIG. 8 or provided with a series of folds 42 to yield a Z or accordion-type structure. The elastic member 45 can also extend from the attachment points 48 in the direction away from fold 41 (not shown) toward the center of the bag 40. This, however, is generally not as preferred as it will place a less desirable peel force angle on the attachment points when the elastic is stretched. Optionally, a hot-melt or low-tack adhesive 43 can be used to keep the elastic member 45 firmly folded until the bag is opened and the elastic member is stretched.

The elastic member 45 in the FIG. 8 embodiment would be located in the upper edge portion 13 of the bag and would be used in a manner identical to the elastic members of the embodiments of FIGS. 1, 3 and 4. Namely, the user would fold over the upper edge portion of the bag around the top or rim of a container with a circumference smaller than that of the fully extended bag (i.e., with the elastic fully extended or stretched), but larger than the bag circumference with the elastic unstrained. This would be the circumference of the bag minus the difference in length of the elastic member(s) and the bag between the attachment points (2(a−b) in FIG. 8, and if elastic was identically placed at both edges of the bag, 4(a−b)). The container circumferences suitable for an invention elasticized bag will generally be between the unstrained bag circumference, plus the length needed to impart the desired degree of stretch (and hence strain) to the elastic up to the circumference of the fully extended bag. Thus, by judicious placement of the elastic members or number of elastic members, the difference in length between the elastic member(s) and the bag between attachment points can be increased, and hence, increase the range of container sizes the bag will fit. As such, a wide range of bag sizes can be accommodated by varying the number, size and placement of the elastic members.

A further alternative is depicted in FIG. 5 which provides an elastic member 35 on a bag sidewall 36, and/or 37, in an unstable state. The elastic can be attached solely at its ends 38, continuously (not shown) or intermittently, as shown in FIG. 7. The elastic is maintained in its unstable state by, e.g., tension, mechanical reinforcement (as per U.S. Pat. No. 4,908,247), or as a heat-unstable film. The elastic, when relaxed, will contract causing a gathering 32 of the bag sidewall as shown in FIG. 6. This relaxation can be as simple as releasing the tension on the elastic strip; however, it may require mechanical manipulation (for a reinforced elastic as per U.S. Pat. No. 4,908,247) or heating of a heat-unstable film. Preferably, the elastic is relaxed after the bag has been packaged into its final form so that the resulting bag sidewall gathering does not interfere with the packaging of multiple bags into a single package. The mechanically reinforced or heat-unstable elastic films could be relaxed by the end user; however, this would be less desirable.

In use, the alternative embodiments of FIGS. 5–7 would operate as per the embodiments of FIGS. 1, 2, 4 and 8. When the bag is placed on a container or receptacle, the elastic will be stretched or in an unstable condition capable of relaxing to an elastic state so as to provide the required tensile force to keep the bag attached to the container.

Alternative elastic member constructions are depicted in FIGS. 9–12 and 14–15. Like numbers indicate like or identical features. These constructions are generally classifiable as elastic tapes. The elastic portions 50 of the tapes can form the entire tape backing as shown, e.g., in FIG. 9, or can be only a central portion 50 of the backing, as per FIGS. 10 and 11. Where the central portion of the backing is elastic, the edge portion 53 is preferably an inelastic thermoplastic which can be formed by a coextrusion process (e.g., the FIG. 10 embodiment) or by lamination or adhesion of separate film elements (as per the FIGS. 11 and 15 embodiments). In the FIG. 15 embodiment, the end portion 53 is a separate tape element with an adhesive coating 52 and a release coating 51. This tape could be attached to the elastic portion 50 prior to attachment to the bag or used to attach the elastic to the bag on the bag assembly line itself.

All these elastic tapes can be provided with conventional release coatings 51 on the backing face portion opposite the face with the adhesive-coated areas 52. The release coatings allow the tape to be wound into a roll form. The roll of elastic tape could then be unwound from the roll and cut into appropriate widths prior to attachment to the bag.

Figure 12:
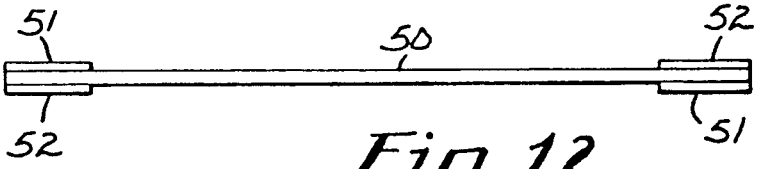
FIG. 12 is an alternative elastic tape construction usable in the embodiments of the invention.
Figure 13:
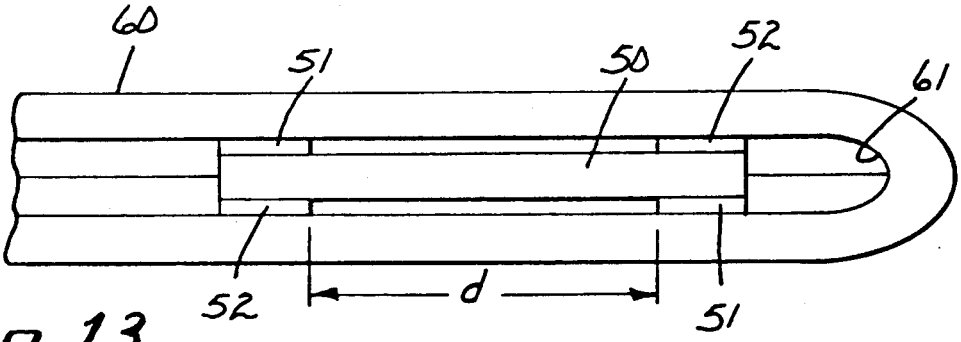
FIG. 13 is a top view of an alternative embodiment of the invention using an elastic tape construction as shown in FIG. 12.

In the embodiment shown in FIG. 12, the adhesive 52 is located in patches on opposite sides of the elastic tape backing 50. This type of tape would be applied to a bag 60 as shown in FIG. 13 close to an edge fold 61. The elastic available for stretching would be d, and the maximum elongation length of the elastic, prior to requiring deformation of the bag wall, would be the length of bag between the adhesive attachment points 62 and 63 plus the width of adhesive patch 63. An advantage with this embodiment is that if it is used inside the bag as per the FIG. 8 embodiment (as shown in FIG. 13), the elastic tape does not need to be folded to attach the tape to the bag inner walls on opposing panels. The tape embodiments of FIGS. 9 to 11 would require folding if placed in the FIG. 8 bag embodiment or the gusseted bag of FIGS. 1 and 3. Without a folded elastic, the bag will have a flatter profile.

Figure 14:
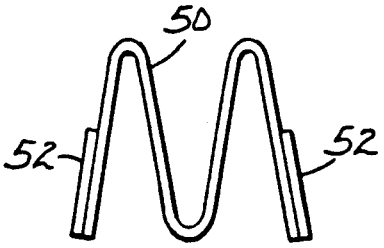
FIG. 14 illustrates an elastic tape construction with multiple folds.

An alternative folding arrangement for a tape to be used in the FIG. 8 embodiment is depicted in FIG. 14. Multiple folds are used on the tape which can be of any size, arrangement or number. This permits use of an elastic with a small footprint while providing sufficient elastic for use in elasticizing the bag. This folded arrangement, or like arrangements, could be employed with any of the elastic tapes of FIGS. 9–12 and 15 (FIG. 12 would require an even number of folds to have outward-facing, adhesive-covered surfaces).

The adhesive 52 used would be a conventional pressure-sensitive adhesive such as used for permanently attaching tape to a diaper outer shell (typically polyethylene). Suitable adhesives for this purpose are A-B block copolymers, typically diblock and/or triblock copolymers where A comprises a monoalkenyl arene, preferably styrene and its derivatives, and B comprises at least one conjugated diene or alkene, where A comprises from about 8 to 50 weight percent of the block copolymer, with the balance substantially comprised of a tackifying resin, preferably a solid tackifying resin with a liquid resin and/or processing oil. The B blocks are preferably comprised of isoprene, butadiene or ethylene-butylene copolymer. Suitable conventional tackifiers would be those as described, e.g., in U.S. Pat. No. 4,861,635 (such as WINGTACK, TM resins available from Goodyear Chemical Company, ESCOREZ TM resins available from Exxon Chemical Company or plasticizing oils such as SHELLFLEX, TM 371 available from Shell Chemical Company). Suitable commercially available block copolymers include the KRATON, TM G and D series available from Shell Chemical Company.

Conventional additives and fillers can also be used such as antioxidants (e.g., t-butylcresol), heat stabilizers (e.g., zinc alkyl dithiocarbamates), ultraviolet stabilizers, pigments and dyes. Suitable adhesive formulations are disclosed, for example, in U.S. Pat. Nos. 4,861,635 and 4,136,071.

Release coatings 51 can also be of conventional compositions used for this purpose, such as urethane or silicone-based release coatings.

The elastic system can also be used in bags as only a closure member or as only a tensioning member.

The elastic member can be formed of any suitable elastomeric material and, for reasons of economy, is preferably a film or band-like material. However, other elastic materials such as elastic strand composites or non-woven elastics are also suitable. Exemplary elastic materials include natural rubber, urethane elastomers, polyether esters, EVA, ethylene propylene copolymer rubber, block copolymer rubbers, butyl rubber, polyisobutadiene and mixtures of these copolymers. The elastic material should be formed so that it exhibits a tensile force of generally from 1 to 50 g/mm when the elastic is extended around the container rim. For example, a force less than 1 g/mm may not be sufficient to keep the bag attached to the container. A force greater than 50 g/mm may cause a common garbage bag to deform or tear. However, to some extent, this can be mitigated by making the elastic member wider, at least at its attachment end (8 in FIG. 3), to distribute the force, or by using bags with greater tear strength. Common garbage bags are formed of polyethylene film generally about 0.0015 inches thick (kitchen bag). Thicker or reinforced (e.g., multilayer) bags can withstand greater inside forces at the point of attachment of the elastic to the bag. For example, large drum liners may withstand forces up to 3 times, or more, forces bearable by conventional trash bags. The elastic can be attached to the plastic bag by any suitable method such as by heat sealing, sonic welding, adhesives or the like. If heat or sonic welding are used, the bag film underlying the film being attached to the elastic must be protected to prevent bonding of the bag to itself. This can be done, for example, with heat shields or precision-controlled welding (e.g., the elastic material and bag film can be selected to have disparate melting points and the welding controlled only to melt the elastic material). The FIG. 8 embodiment may not need such protection if the elastic tape serves this function without bonding to itself.

The bag can also be of any conventional flexible material usable for the purposes described herein. This material would conventionally be a thermoplastic material suitable for formation of a film, e.g., polyethylene. However, other flexible film-like materials could be used to form the bag such as paper, non-woven webs, woven materials or the like.

Heat-shrink elastomers can also be used, for example, in the embodiments depicted in FIGS. 5-7. Such heat-shrink elastomers are described in Massengale et al., U.S. Pat. No. 3,819,401 (polyvinyl chloride polymers and copolymer elastomers with one or more plasticizers); Koch et al., U.S. Pat. No. 3,912,565 (a polyurethane elastic such as ESTANE TM 58054 from B.F. Goodrich Company, Cleveland, Ohio); U.K. Application No. 2,160,473 A (a copolymer of polyamide and polyether block segments such as "PEBAX-2533") and Cook RE 28,688 (a broad range of elastics admixed with a heat-flowable constituent having a softening point temperature above 140° F. The elastic is deformed above the heat-flowable constituent softening point and rapidly cooled. The elastic is activated by heating again to a temperature above the heat-flowable constituent softening point. Exemplified blends include polychloroprene elastomers (80-90 parts) with polyvinyl chloride (10-40 parts) as the memory ingredient, a silicone elastomer with polyethylene, polystyrene or a silicone resin memory ingredient, among others).

Reinforced elastics can be used, such as described in Baird, U.S. Pat. No. 4,908,247. Baird describes stretching an elastomeric material which is then adhered to a rigidifying material which prevents the elastic from recovering. The elastic is released from its tensioned state and allowed to recover by removing or destroying the rigidifying member. A preferred method of removing the rigidifying member is by mechanical manipulation. The rigidifying member is described as anything from polyethylene to steel applied by methods such as lamination, melt coating or solvent casting the rigidifying member onto the stretched elastic, or by mechanical attachment. A thin, low-tack adhesive layer would also function, in which case the rigidifying member could be a pressure-sensitive adhesive tape with the backing serving as the rigidifying layer. The degree of adhesion to the stretched elastic, however, would have to be low enough so that the rigidifying member could be easily removed by, e.g., mechanical manipulation. The rigidifying member would desirably be a thermoplastic material such as a polyolefin, a polystyrene, a polyester or a polyacrylate. Rigidifying members would also preferably be on both sides of the elastic so as to prevent curl. However, in some circumstances, the garbage bag could serve as one rigidifying member. For example, if the garbage bag was continuously bonded to the elastic, the bag wall, any adhesive or bonding layer(s) and other intermediary layers, would function as rigidifying elements.

A preferred elastic material is that described in copending U.S. application No. 503,716, filed Mar. 30, 1990, a continuation-in-part of U.S. application No. 438,593, filed Nov. 17, 1989. This material is a composite elastomeric laminate having at least one elastomeric core layer and at least one substantially inelastic skin layer. When cast, or after formation, the elastomeric laminate behaves in a substantially inelastic manner. Elasticity can be imparted to the laminate by stretching the laminate by at least a minimum activation stretch or draw ratio, wherein an elastomeric material will form immediately, over time or upon the application of heat. The method by which the elastomeric material is formed can be controlled by a variety of means. After the laminate has been converted to an elastomeric material, there is formed a novel texture in the skin layer(s) that provides significant advantages to the elastomeric laminate.

The elastomeric laminate is non-tacky both before and after it has the microtextured surface. This facilitates handling during manufacturing and minimizes the possibility of bags blocking when folded and packaged, e.g., as a roll. The material also has a reduced tendency to neck when stretched and degrade prior to use. Recovery can also be slightly delayed so that the elastic does not snap back immediately when placed on the trash container.

The elastomer used for the elastomeric layer can broadly include any material which is capable of being formed into thin films and exhibits elastomeric properties at ambient conditions. Elastomeric means that the material will substantially resume its original shape after being stretched. Further preferably, the elastomer will sustain only small permanent set following deformation and relaxation which set is preferably less than 20 percent and more preferably less than 10 percent of the original length at moderate elongation, e.g., about 400-500%. Generally, any elastomer is acceptable which is capable of being stretched to a degree that will cause permanent deformation in the relatively inelastic skin layer. This can be as low as 50% elongation. Preferably, however, the elastomer is capable of undergoing up to 300 to 1200% elongation at room temperature, and most preferably up to 600 to 800% elongation at room temperature. The elastomer can be both pure elastomers and blends with an elastomeric phase or content that will still exhibit substantial elastomeric properties at room temperature.

The skin layers can be formed of any semi-crystalline or amorphous polymer that is less elastic than the elastomeric core(s) and will undergo permanent deformation at the stretch percentage that the elastomeric core(s) will undergo. Therefore, slightly elastic compounds, such as some olefinic elastomers, e.g., ethylene-propylene elastomers or ethylene-propylene-diene terpolymer elastomers or ethylenic copolymers, e.g., ethylene vinyl acetate, can be used as skin materials, either alone or in blends. However, the skin is generally a polyolefin such as polyethylene, polypropylene, polybutylene or a polyethylene-polypropylene copolymer, but may also be wholly or partly polyamide such as nylon, polyester such as polyethylene terephthalate, polyvinylidene fluoride, polyacrylate such as poly(methyl methacrylate) (only in blends) and the like, and blends thereof. The skin material selection can be influenced by the type of elastomer selected. If the elastomeric core is in direct contact with the skin, the skin should have sufficient adhesion to the elastomeric core(s) such that it will not readily delaminate. Where a high modulus elastomeric core(s) is used with a softer polymer skin, a microtextured surface may not form.

Other layers may be added between the elastomeric core(s) and the skin such as tie layers to improve bonding, if needed. Tie layers can be formed of, or compounded with, typical compounds for this use including maleic anhydride modified elastomers, ethyl vinyl acetates and olefins, polyacrylic amides, butyl acrylates, peroxides such as peroxypolymers, e.g., peroxyolefins, silanes, e.g., epoxysilanes, reactive polystyrenes, chlorinated polyethylene, acrylic acid modified polyolefins and ethylvinyl groups and the like, which can also be used in blends or as compatibilizers in one or more of the matrix or the elastomeric core(s). Tie layers are sometimes useful when the bonding force between the matrix and elastomeric core is low, although the intimate contact between skin and elastomeric core should counteract any tendency to delaminate. This is often the case with a polyethylene skin as its low surface tension resists adhesion.

Additives to the elastomeric core discussed above can significantly affect the shrink-recovery mechanism. For example, stiffening aids such as polystyrene can shift an other wise heat-shrinkable material into a time- or instant-shrink material. However, the addition of polypropylene or linear low-density polyethylene (less than 15%) to a styrene/isoprene/styrene block copolymer layer resulted in exactly the opposite effect, namely transforming time- or instant-shrink materials to heat-shrink or no-shrink materials. However, the possibility of polyolefin use in the elastomeric layer is significant from a processing standpoint in permitting limited recycling of off batches. Also, polyolefin additives can lower extruder torque.

The overall structure of the film material may be formed by any convenient process such as by pressing materials together, coextruding or the like, but coextrusion is the preferred process for forming the material. The elastomeric core and skin layers are typically coextruded through a specialized die and feedblock that will bring the diverse materials into contact while forming the film material.

The die and feedblock used are typically heated to facilitate polymer flow and layer adhesion. The temperature of the die depends upon the polymers employed and the subsequent treatment steps, if any. Generally, the temperature of the die is not critical, but temperatures are generally in the range of 350° to 550° F. (176.7° to 287.8° C.) with the polymers exemplified.

After formation, the film material is stretched past the elastic limit of the skin layer(s) which deforms. The stretched elastomeric core then recovers instantaneously, with time or by the application of heat. For heat-activated recovery, the inherent temperature of heat activation is determined by the composition used to form the elastomeric core(s) of the composite film material in the first instance. However, for any particular composite film, a heat-activatable elastomeric core material activation temperature can be adjusted by varying the matrix skin/core ratios, adjusting the percent stretch or the overall film thickness.

The counter-balancing of the elastic modulus of the elastomeric core and the deformation resistance of the skin layer(s) also modifies the stress-strain characteristics of the activated regions of the film material. For example, a relatively constant stress-strain curve can be achieved. This relatively constant stress-strain curve can also be designed to exhibit a sharp increase in modulus at a predetermined stretch percent.

When used, the composite material is initially inelastic. It is then stretched, and at an activation point, the elastic recovery forces of the elastomeric core will overcome the restraining forces of the skin layers. At this point, the composite can be released and will be elastic. The amount of stretch required to activate the composite into its elastic state will depend on the materials employed, the relative thicknesses of the core and/or skin layers and the presence of any modifying agents.

When present on the gusseted bag of FIGS. 1-4 or the included elastic in the bag of FIGS. 8 and 13, the maximum amount of stretch impartable to the elastic by placing the bag on a container can be expressed by the following equation:

$$D_R = F_L/d + 1$$

where $D_R$ is the draw ratio, $F_L$ is the length of the gusset fold or bag between the elastic attachment point (2 times b in FIGS. 3 and 8) and d is the length of the elastic from attachment zone to attachment zone (the total amount of elastic available for stretch, 2 times a in FIGS. 3 and 8). Thus, the draw ratio (stretch) for a particular elastic member can be increased by increasing the gusset fold length or decreasing the elastic length d. The minimum draw ratio required to activate the preferred elastic described above will vary as discussed above. However, a draw ratio from 2.5:1 to 7:1 will generally be sufficient for most constructions. With a given minimum draw ratio ($D_R$) requirement for a material and a given bag material length ($F_L$), a suitable elastic length (d plus attachment regions) can be determined using the above equation. Preferably, the elastic length d should be selected so that the draw ratio will be above the minimum required by at least 10%, and preferably 20%. Of course, all this is going to be constrained by the range of container diameters the bag is designed to fit as discussed above. In this case, the amount of stretch or draw available to elongate the elastic would be $C_d-(B_d-(DL_1+...DL_i))$, where $C_d$ is the container diameter, $B_d$ the bag diameter and $DL_i$ is the difference between the length of the bag and the elastic between adhesive attachment points for the $i_{th}$ elastic. Given these constraints, suitable bags can be designed to fit a range of containers.

The following examples are provided to illustrate presently contemplated preferred embodiments and the best mode for practicing the invention, but are not intended to be limiting thereof.

EXAMPLE 1

An elastic composite was formed by coextruding an elastomeric core and two skin layers through a CLOEREN TM (Cloeren Co., Orange, Tex.) three-layer feedblock and an 18 inch (45.7 cm) film die. The core comprised 89% styrene-isoprene-styrene (KRATON TM D-1107, Shell Chemical Co., Beaupre, Ohio), and 10% poly(alpha-methyl)styrene (AMOCO TM 18-210, Amoco Oil Co., Chicago, Ill.) and 1% IRGANOX TM 1076 (Ciba-Geigy Corp., Hawthorne, N.Y.). The skin material comprised polypropylene (ESCORENE, TM 3085, Exxon Corp., Houston, Tex.). The ratio of a skin layer to the core was approximately 6.6:1 for a 5.0 mil (0.12 mm) film. The film was then cut and attached to gusseted polyethylene with a transfer adhesive tape (3M 443 SCOTCH TM double-coated SBS synthetic rubber-based adhesive tape). The dimensions of the bags and the elastic strips are given in Table I below.

TABLE I

| Gusset Depth (in cm) | $F_L$ (in cm) | $D_R$ | d (in cm) | Tab Width (in cm) | Adhesive Length (in cm) | Total Tab Length (in cm) |
|---|---|---|---|---|---|---|
| 8.9 | 17.8 | 5.5 | 3.9 | 2.5 | 2.5 | 9.0 |
| 6.4 | 12.7 | 5.5 | 2.8 | 2.5 | 1.3 | 5.3 |
| 5.1 | 10.2 | 5.5 | 2.2 | 2.5 | 1.3 | 4.8 |

The bags were GLAD TM large kitchen trash bags folded to provide the above indicated gusset lengths. When used in a standard-size kitchen bag (a RUBBERMAID TM 30-quart trash can, No. 2846), all the above samples functioned adequately.

The various modifications and alterations of this invention will be apparent to those skilled in the art without departing from the scope and spirit of this invention, and this invention should not be restricted to that set forth herein for illustrative purposes.

We claim:

1. A gusseted flexible bag or the like comprising:

two panels of a thin, thermoplastic film forming a closed bottom and open top, wherein the panels are joined along at least one panel side edge via a gusset edge fold, each gusset edge fold comprising two leading edge folds one along a longitudinal edge of each of said panels and at least one inner fold region, and at least one elastic member having at least two opposing ends wherein one of said ends is attached at an attachment region to each panel face adjacent a leading edge fold and the top edge, so that the elastic is folded over the gusset edge fold and the fold line of the elastic is closely adjacent the outermost leading edge fold line, and the elastic, when the gusset is fully unfolded, exerts a tensile force of between 1 and 50 g/mm.

2. The gusseted bag of claim 1 wherein there is a gusset fold along each panel side edge.

3. The gusseted bag of claim 2 wherein an elastic member is folded over each gusset.

4. The gusseted bag of claim 1 wherein the elastic member comprises a composite film of an elastomeric core layer and at least one inelastic skin layer wherein the material is capable of becoming elastic after being stretched by a minimum activation draw ratio.

5. The gusseted bag of claim 4 wherein an elastic member maximum length is determined by the following equation:

$$d = \frac{F_L}{D_R - 1}$$

where $F_L$ is the length of the gusset fold and $D_R$ is the minimum draw ratio required to activate film to the elastic state and d is the length of the elastic member between the elastic member attachment regions.

6. The gusseted bag of claim 5 wherein $D_R$ is at least 10% above the minimum activation draw ratio.

7. The gusseted bag of claim 1 wherein the elastic member is located ⅛ to 6 inches (0.3 to 15.1 cm) from a top edge of the bag.

8. A gusseted flexible bag consisting essentially of: two panels forming a closed bottom and open top, at least one gusset fold comprising two leading edge folds and at least one inner fold region on at least one panel, and one elastic member having two opposing ends wherein one of said ends is attached at an attachment region on either side of one gusset fold.

9. The gusseted bag of claim 8 wherein the elastic member when the gusset is fully unfolded exerts a tensile force of between 1 and 50 g/mm.

10. The gusseted bag of claim 8 wherein the elastic member comprises a composite film of an elastomeric core layer and at least one relatively inelastic skin layer wherein the material is capable of becoming elastic after being stretched by a minimum activation draw ratio.

11. The gusseted bag of claim 10 wherein an elastic member maximum length is determined by the following equation:

$$d = \frac{F_L}{D_R - 1}$$

where $F_L$ is the length of the gusset fold and $D_R$ is the minimum draw ratio required to activate the composite film to the elastic state and d is the length of the elastic member between the elastic member attachment regions.

12. The gusseted bag of claim 11 wherein $D_R$ is at least 10% above the minimum activation draw ratio.

13. The gusseted bag of claim 8 wherein the elastic member is located ⅛ to 6 inches (0.3 to 15.1 cm) from a top edge of the bag.

14. A flexible bag comprising side walls forming a closed bottom and an open top and an upper edge region, and at least one elastic member having at least two opposing ends attached at two spaced-apart attachment points on said upper edge region wherein said elastic, between said attached ends, has a length less than the length of said bag between said attachment points when said elastic is in its relaxed elastic state wherein the elastic member is attached to interior faces of said sidewall.

15. The bag of claim 14 wherein the at least one elastic member is attached to two opposing panels, and the bag is formed from a thermoplastic material.

16. The bag of claim 14 wherein the elastic member is provided with at least one fold.

17. The bag of claim 16 wherein the elastic member comprises a folded tape having adhesive-coated regions at either end and a central elastic region.

18. The bag of claim 17 wherein the adhesive-coated regions of said tape are substantially inelastic.

19. The bag of claim 14 wherein the elastic member exerts a tensile force of between 1 and 50 g/mm when stretched to the bag length between the attachment points.

20. The bag of claim 4 wherein the elastic member is located ⅛ to 6 inches (0.3 to 15.1 cm) from a top edge of the bag.

21. The bag of claim 14 wherein said two opposing ends are attached to said upper edge region at opposing faces of said elastic member.

22. The bag of claim 21 wherein the elastic member is provided as a flat unfolded strip.

23. A method for fitting a flexible bag to a container comprising the steps of:

(a) providing sidewalls forming a closed bottom and an open top and an upper edge region, and at least one elastic member having at least two opposing ends attached at two spaced-apart points on said upper edge region wherein said elastic member, between said attached ends, has a length less than the length of said bag between said attachment points when said elastic member is in its relaxed elastic state, (b) folding said upper edge region around the rim of a container having a circumference less than the bag circumference but greater than bag circumference minus the difference between the elastic member and the bag length between the attachment points, and (c) stretching said at least one elastic member on the outside of said container so as to retain the bag thereon.

24. The method of claim 23 wherein the elastic member exerts a tensile force of between 1 and 50 g/mm when stretched.

25. A flexible bag comprising, two side walls forming a closed bottom and an open top and an upper edge region, and at least one elastic member having at least two opposing ends attached at two-spaced-apart points on one side wall on said upper edge region wherein said elastic, between said attached ends, has a length less than the length of said bag between said attachment points when said elastic is in its relaxed elastic state.

26. The bag of claim 25 wherein the elastic member is attached to interior faces of said sidewalls and provided with at least one fold.

27. The bag of claim 26 wherein the elastic member is a folded tape having adhesive-coated regions at either end and a central elastic region.

28. The bag of claim 27 wherein the adhesive-coated regions of said elastic tape are substantially inelastic.

29. The bag of claim 25 wherein the elastic exerts a tensile force of between 1 and 50 g/mm when stretched to the bag length between the attachment points.

30. The bag of claim 25 wherein the elastic member is located ⅛ to 6 inches (0.3 to 15.1 cm) from the top edge of the thermoplastic bag.

31. The bag of claim 25 wherein the elastic member is attached to interior faces of said sidewalls and said two opposing ends are attached to said upper edge region at opposing faces of said elastic member.

32. The bag of claim 31 wherein the elastic member is provided as a flat unfolded strip.

* * * * *

UNITED STATES PATENT AND TRADEMARK OFFICE

CERTIFICATE OF CORRECTION

PATENT NO. : 5,120,138

DATED : June 9, 1992

INVENTOR(S) : Roland R. Midgley, Keith E. Moe, Bradley W. Eaton, and William J. Bond

It is certified that error appears in the above-identified patent and that said Letters Patent is hereby corrected as shown below:

Column 1, line 66, delete "5,913,560" and insert --4,913,560--.

Col. 1, line 67, delete "Harrington and Harrington: and insert --Herrington and Herrington--.

Column 12, line 41, delete "4" and insert "14".

Signed and Sealed this

Twenty-fourth Day of August, 1993

Bruce Lehman

*Attest:*

BRUCE LEHMAN

*Attesting Officer*

*Commissioner of Patents and Trademarks*